US009321561B2

(12) United States Patent
Graux et al.

(10) Patent No.: US 9,321,561 B2
(45) Date of Patent: Apr. 26, 2016

(54) PLUG FOR CLOSING NECK OF CONTAINER AND PACKAGING ASSEMBLY INCLUDING PLUG

(71) Applicant: Tetra Laval Holdings & Finance S.A., Pully (CH)

(72) Inventors: Stéphane Graux, Liergues (FR); Richard Lamoureux, Rawdon (CA)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 14/371,749

(22) PCT Filed: Jan. 11, 2013

(86) PCT No.: PCT/EP2013/050500

§ 371 (c)(1),
(2) Date: Jul. 11, 2014

(87) PCT Pub. No.: WO2013/104763

PCT Pub. Date: Jul. 18, 2013

(65) Prior Publication Data

US 2015/0001173 A1 Jan. 1, 2015

(30) Foreign Application Priority Data

Jan. 13, 2012 (FR) ..... 12 50351

(51) Int. Cl.
*B65D 41/46* (2006.01)
*B65D 41/48* (2006.01)
(Continued)

(52) U.S. Cl.
CPC *B65D 41/28* (2013.01); *B65D 1/02* (2013.01); *B65D 41/34* (2013.01); *B65D 41/485* (2013.01); *B65D 51/1661* (2013.01); *B65D 85/72* (2013.01); *B67D 3/0035* (2013.01)

(58) Field of Classification Search
CPC ..... B65D 41/46; B65D 41/48; B65D 2101/0053; B65D 41/28; B65D 1/02; B65D 41/34; B65D 41/485; B65D 51/1661; B65D 85/72; B67D 3/0035
USPC ..... 215/320, 254, 344
See application file for complete search history.

(56) References Cited

U.S. PATENT DOCUMENTS 3,653,529 A * 4/1972 Segmuller ..... 215/256
3,901,403 A * 8/1975 Menke ..... 215/251
(Continued)

FOREIGN PATENT DOCUMENTS

CA 2418456 A1 8/2004
GB 854571 A 11/1960
(Continued)

OTHER PUBLICATIONS

International Search Report in PCT/EP2013/050500, mailed Apr. 5, 2013 (3 pages).

*Primary Examiner* — Mickey Yu
*Assistant Examiner* — Niki Eloshway
(74) *Attorney, Agent, or Firm* — Finnegan, Henderson, Farabow, Garrett & Dunner, L.L.P.

(57) ABSTRACT

A plug for closing a neck of a carboy is disclosed. The plug comprises a cap for obturating the neck and a skirt for attachment to the neck. The skirt includes a first skirt portion, provided with a bulging line for interfering by jamming with the neck, and a second skirt portion, adapted for substantially encircling snugly an outer face of the neck. In order to avoid the presence of liquid between an outside of the neck and an inside of the skirt after placement of the plug, an inner face of the second skirt portion is provided with draining means adapted for delimiting fluid flow passages between the second skirt portion and the neck, which connect with each other opposite axial ends of the second skirt portion.

8 Claims, 4 Drawing Sheets

(51) Int. Cl.

| | |
|---|---|
| ***B65D 41/28*** | (2006.01) |
| ***B65D 1/02*** | (2006.01) |
| ***B65D 41/34*** | (2006.01) |
| ***B65D 51/16*** | (2006.01) |
| ***B65D 85/72*** | (2006.01) |
| ***B67D 3/00*** | (2006.01) |

(56) References Cited

U.S. PATENT DOCUMENTS

| | | | | |
|---|---|---|---|---|
| 4,066,180 | A * | 1/1978 | Sanchez | 215/254 |
| 4,646,947 | A | 3/1987 | Stull | |
| 5,603,422 | A * | 2/1997 | Herrmann | 215/256 |
| 7,051,892 | B1 * | 5/2006 | O'Day, Jr. | 215/383 |
| 2003/0150834 | A1 * | 8/2003 | Verderber | 215/254 |
| 2005/0218106 | A1 * | 10/2005 | Yui | 215/256 |
| 2008/0053947 | A1 * | 3/2008 | Prozumenshchikov | 215/266 |

FOREIGN PATENT DOCUMENTS

| | | | |
|---|---|---|---|
| WO | WO 03/059770 | A2 | 7/2003 |
| WO | WO 2004/108584 | A1 | 12/2004 |

* cited by examiner

PLUG FOR CLOSING NECK OF CONTAINER AND PACKAGING ASSEMBLY INCLUDING PLUG

CROSS-REFERENCE TO RELATED APPLICATIONS

This is a U.S. National Phase of PCT/EP20131050500, filed Jan. 11, 2013, which claims the benefit of priority to French Patent Application No. 1250351, filed Jan. 13, 2012, which is incorporated herein by reference.

TECHNICAL FIELD

The present invention relates to a plug for closing the neck of a container, as well as to a packaging assembly comprising such a plug.

BACKGROUND

The invention addresses in particular the case of containers consisting of a carboy of liquid, capable of containing at least about ten liters of liquid, notably water, typically water carboys of three, four or five gallons, which are used in the upside down position in dispensing fountains. The neck of these carboys is closed by a plug generally described as a <<snapped-on>> plug, i.e. a plug for which the tubular skirt is able to be interiorly clipped or more generally coaxially blocked around the neck, unlike screwed plugs for example. An example of such a plug is provided by WO-A-2004108584 on which the preamble of appended claim 1 is based. Most carboys of this type are reusable many times, by getting rid of their plug and then cleaned before each filling.

For various reasons, notably economic and ecological reasons, the carboys historically used, made in polycarbonate, are today increasingly replaced frequently with carboys in less rigid plastics, notably in polyethylene terephthalate. The result of this is that during the operation for plugging such a carboy after the latter has been filled, the setting into place of the plug by force on the neck causes a non-negligible elastic deformation of the whole carboy, which is thus crushed along the axis of its neck: the liquid level in the carboy is then raised relatively to the carboy so that it is frequent that a little liquid flows out of the carboy, by passing over the tree and of the neck, and then by flowing exteriorly around this neck, and this, at the moment when the plug is fixed around this free end. Under these conditions, liquid is found trapped in a substantially leakproof way between the outside of the neck and the skirt of the plug, this skirt being actually designed for snugly encircling the neck. Subsequently, the presence of this thereby trapped liquid is often perceived, moreover wrongly by the user as a lack of seal of the obturation of the neck. The presence of the capped liquid is moreover particularly visible when the carboy is, after filling and obturation, laid horizontally for purposes of storage and/or transport. Moreover, in the long run, this stagnant liquid between the outside of the neck and the inside of the skirt of the plug may be a source of hygiene issues, such as bacterial contamination.

The object of the present invention is to improve the plugs of the type mentioned above, in order to avoid the presence of liquid between the outside of the neck and the inside of the skirt after placement of the plug on the neck.

BRIEF SUMMARY

For this purpose, the object of the invention is a plug for closing the neck of a container, as defined in claim 1.

One of the ideas at the basis of the invention is not seeking to prevent liquid from the inside of the neck from being able to reach, for the reasons explained above, the outside of this neck during the setting into place of the plug, but is seeking to allow liquid, thus found between the outside of the neck and the skirt of the plug, to be discharged by drainage outside the plug. To do this, the invention makes provision for an arrangement of the inner face of the skirt portion which, in the closing configuration of the plug, is fitted around the neck and encircles an associated portion of the outer face of the latter: this inner face of the aforementioned skirt portion is designed in order to make passages so that the liquid flows between this aforementioned skirt portion and the neck. These flow passages are provided in order to connect the opposite axial ends of the aforementioned skirt portion, so that they connect a first axial side of this skirt portion, which is turned towards the cap of the plug and where liquid, after having overflowed from the carboy during the setting into place of the plug, may be found trapped between the inside of the remainder of the skirt and the outside of the neck, and the opposite axial side of this skirt portion, opening or, at the very least, in free communication with the outside of the plug. In this way, the aforementioned trapped liquid may naturally flow in the flow passages provided by the invention and thereby pass from the first axial side to the second axial side of the aforementioned skirt portion and may therefore reach the outside of the plug. In practice, it is understood that, depending on the specific position occupied by the carboy in space upon setting into place the plug, as well as on the amount of liquid to be drained, all the flow passages or else only some of them are actually followed by the liquid in order to reach the outside of the plug, it being noted that it is necessary that the liquid to be discharged may be replaced with inflowing air in order to avoid the retention of liquid by a suction cup effect. Moreover it is not excluded that, upon setting the plug into place on the neck, all the flow of passages are saturated with liquid so that, by a suction cup effect, this liquid is retained upstream from the passages, without being able to flow as long as the neck extends vertically: in this case, the drainage of the liquid will only occur when the carboy will be tilted relatively to the vertical, notably when it will be laid for purposes of storage and/or transport, the one or those of the flow passages, in which the liquid will then actually flow, being those turned downwards. Moreover, in all the cases, after draining the liquid, the residual traces of humidity inside the skirt also disappear rapidly under the action of the ambient air circulating in the flow passages.

As this will be described in more detail subsequently, a preferential embodiment of the invention is based on the presence of protruding ribs on the inner face of the aforementioned skirt portion, these ribs delimiting between them, along the periphery of the skirt, the flow passages mentioned above. This being the case, the invention encompasses other embodiments.

Advantageous additional features of the plug according to the invention are specified in dependent claims 2 to 9.

The object of the invention is also a packaging assembly, as defined in claim 10.

Advantageously, the aforementioned carboy is in polyethylene terephthalate.

BRIEF DESCRIPTION OF THE DRAWINGS

The invention will be better understood upon reading the description which follows, only given as an example and made with reference to the drawings wherein:

FIG. 5 is different from the one of FIG. 2.

DETAILED DESCRIPTION

Figure 1:
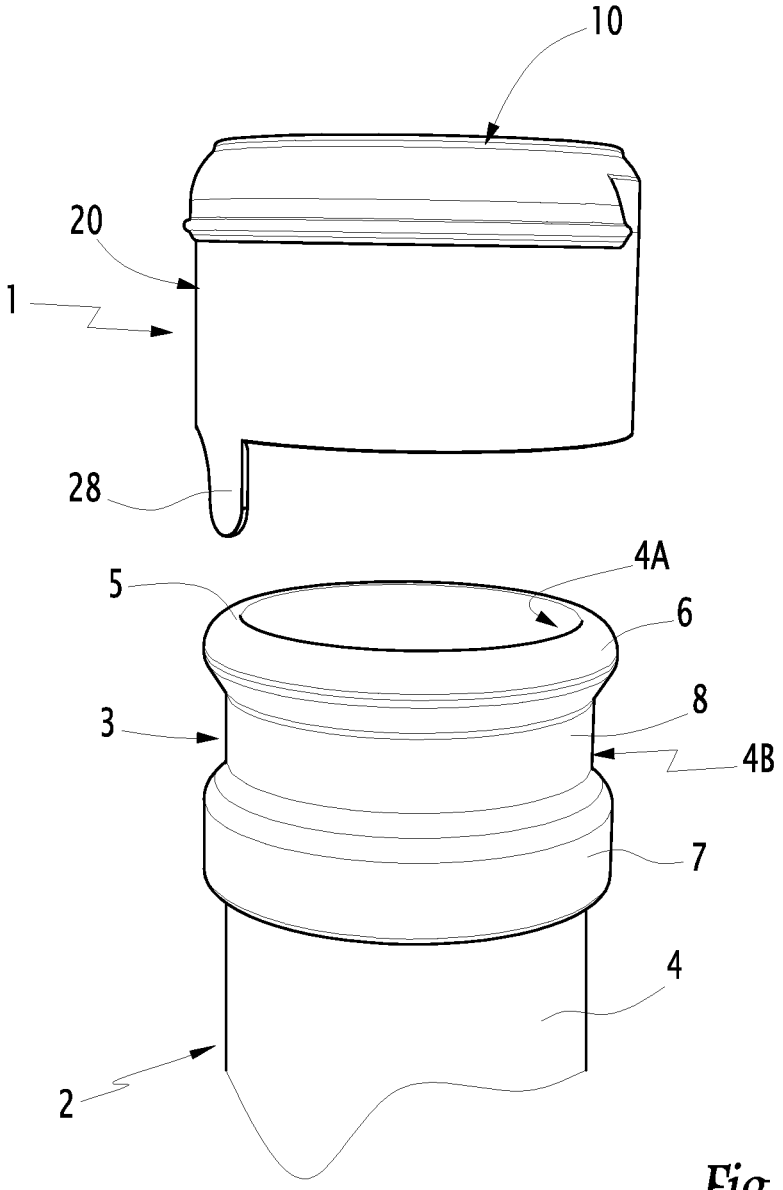
FIG. 1 is an exploded perspective view of a plug according to the invention and of a neck of a container which may be closed with the plug.

In FIGS. 1 to 5, a plug 1 is illustrated, capable of closing the neck 3 of a container 2.

Generally, the neck is either made with the remainder of the container 2 in the same material, notably when the latter is a glass or plastic container, or adapted so as to be permanently attached onto a wall of the container 2, at an aperture crossing this wall. As discussed in the introductory portion of the present document, the container 2 is preferentially a carboy containing at least about ten liters of liquid, notably a water carboy having a capacity of three, four or five gallons.

The neck 3 has a globular tubular shape, the central longitudinal axis is referenced as X-X. By convenience, the following of the description of the plug 1 is oriented with respect to the axis X-X, by considering that the terms of <<lower>> and <<bottom>> describe a portion of the plug which is directed axially towards the main body of the container 2 when the plug 1 obturates the neck 3 of this container and while the latter lies on a horizontal plane, such as a table, with its neck 3 directed upwards, as in FIGS. 1, 2 and 5. Conversely, the terms of <<upper>> and <<top>> correspond to an axial direction of opposite sense. Also, the term of <<inner>> describes a portion of the plug 1 which is directed transversely towards the axis X-X, while the term of <<outer>> corresponds to a transverse direction of opposite sense.

The neck 3 includes a globally tubular body 4, with a circular base and centered on the axis X-X. The top axial end 5 of the body 4 is free, while being open on the outside, while, at its opposite axial end, the body 4 opens into the main body, not shown, of the container 2. The free end 5 of the body 4 connects the inner 4A and outer 4B faces of this body with each other. The outer face 4B of the body 4 is provided with an upper heel 6 and with a lower shouldered protrusion 7, which both protrude outwards and which, in the exemplary embodiment considered in the figures, are spaced apart axially from each other, while thereby delimiting between them an annular groove 8 running over the whole outer periphery of the body 4 of the neck 3.

Figure 2:
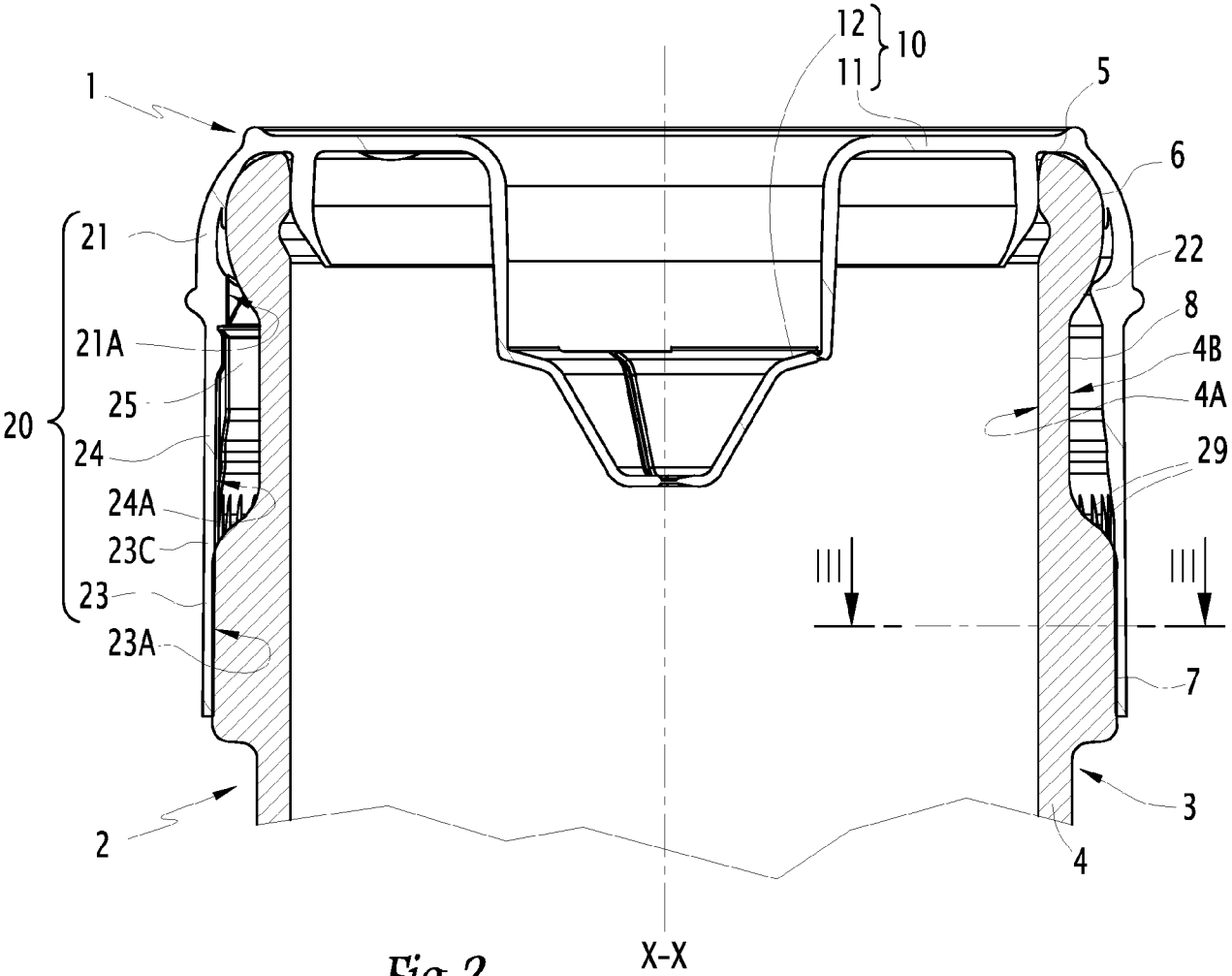
FIG. 2 is a longitudinal sectional view of the plug of FIG. 1, in the closing configuration of the neck.
Figure 3:
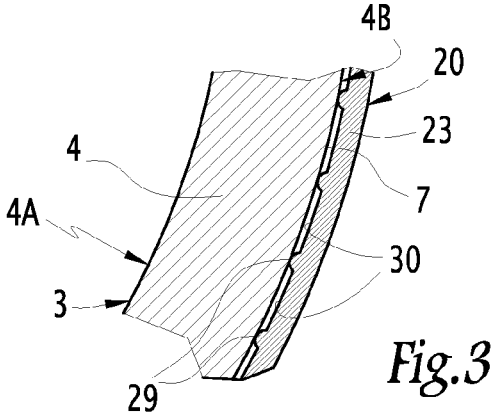
FIG. 3 is a partial sectional view along the line III-III of FIG. 2.

As this is well visible in FIGS. 1 to 4, the plug 1 has a globally tubular shape, the central longitudinal axis of which coincides with the axis X-X of the neck 3 when the plug 1 is set into place on the neck. The plug 1 is open at its lower end and closed at its upper end by a cap 10 which, when the plug 1 is in a closing configuration on the neck 3, like in FIG. 2, is laid out across the inner aperture of the neck, so as to obturate the latter. The outer peripheral portion 11 of the cap 10 is globally planar. The inner peripheral portion 12 of the cap 10 as for it has a staged tubular shape, centered on the axis X-X, which is typically intended to cooperate with a supply head of a water fountain and which will not be described further herein insofar that this aspect of the plug 1 is not a limitation of the invention.

At the outer periphery of the cap 10, a globally tubular skirt 20 extends downwards, centered on the axis X-X and with a circular base, having been made in the same material with the peripheral portion 11 of the cap.

Figure 4:
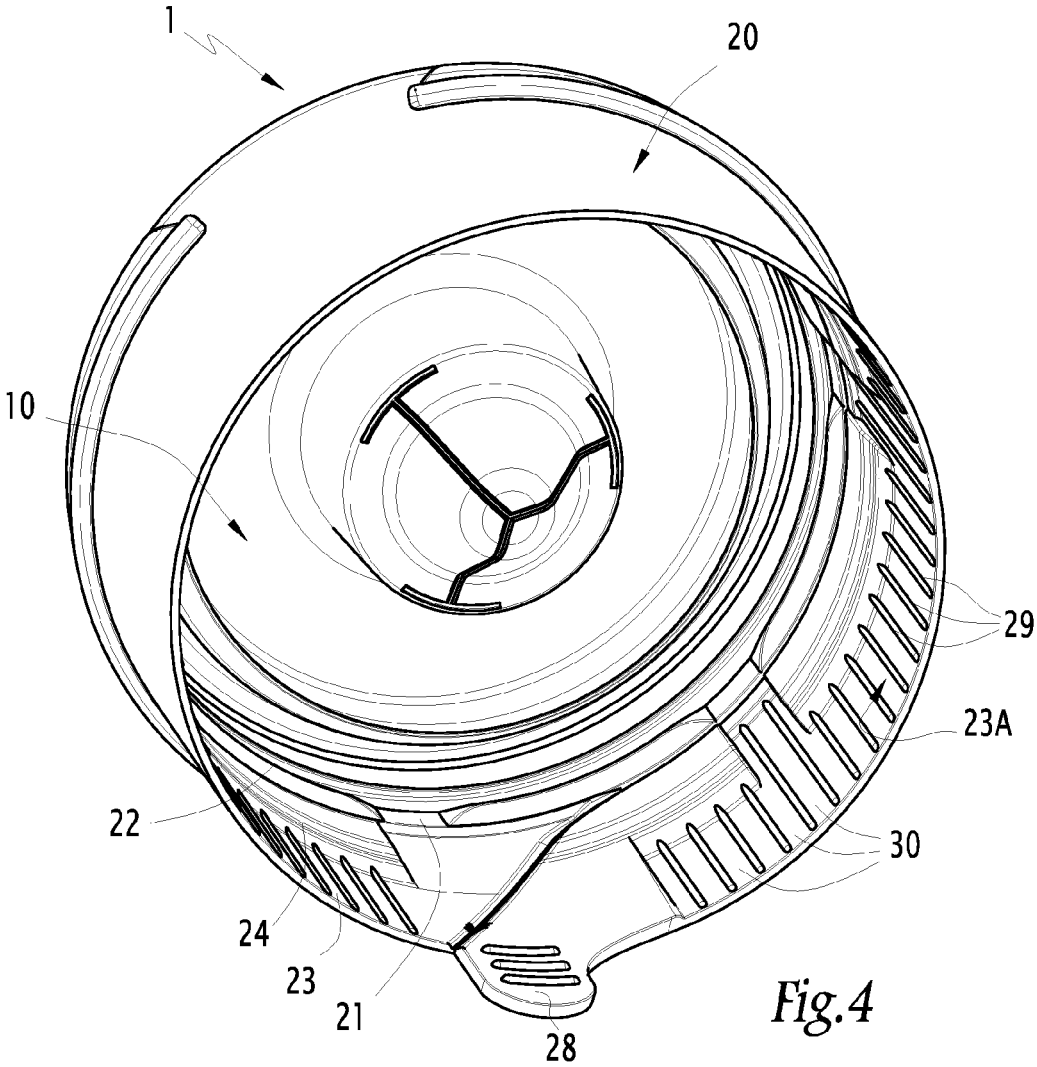
FIG. 4 is a perspective view of the plug of FIG. 1.
Figure 5:
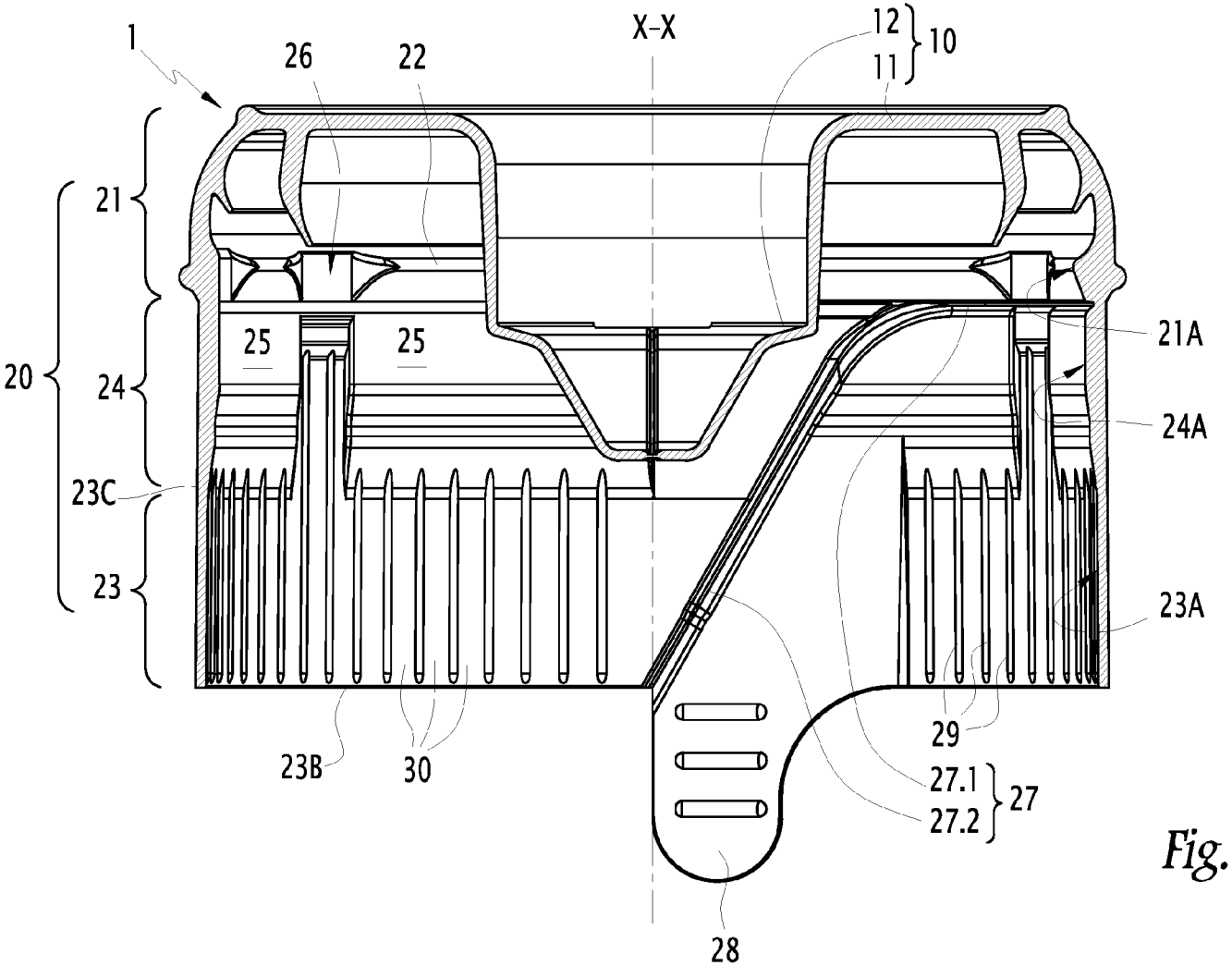
FIG. 5 is a longitudinal sectional view of the plug of FIG. 1, it being noted that the sectional plane of this

As this is well visible in FIGS. 2, 4 and 5, the skirt 20 includes an upper terminal portion 21 which connects the remainder of the skirt 20 to the cap 10. This skirt portion 21 has an inner face 21A provided with a bulging line 22 which protrudes inwards and which runs over the whole periphery of the skirt. This bulging line 22 is designed so as to cooperate by diametrical interference with the heel 6 of the neck 3 for purposes of attachment by jamming of the skirt 20 coaxially around the neck when the plug 1 is in a closing configuration on this neck, as shown in FIG. 2.

In the embodiment considered in the figures, the bulging line 22 runs over the inner periphery of the skirt portion 21 while being regularly interrupted, which amounts to stating that this bulging line 22 consists of a succession of bulging portions, distributed along the periphery of the inner face 21A of the skirt portion 21. In a way known per se, this layout i.a. aimed at increasing the transverse flexibility of the skirt 20 at the axial level of the bulging line 22. Of course, as an alternative not shown, the bulging line may be provided so as to be continuous over the whole inner periphery of the skirt portion 21.

Also as well visible in FIGS. 2, 4 and 5, the skirt 20 further includes a lower terminal portion 23 which is connected, along the direction of the axis X-X, to the skirt portion 21 through an intermediate portion 24 of the skirt 20. It will be noted that, in the embodiment considered in the figures, the skirt 20 thus consists of the skirt portions 21, 23 and 24.

The lower terminal portion 23 has an inner face 23A which, when the plug 1 is in a closing configuration on the neck 3, substantially covers snugly the shouldered protrusion 7 of the neck, as shown in FIG. 2: in other words, this inner face 23A of the skirt portion 23 is designed so as to encircle the shouldered protrusion 7 of the neck 3, i.e. more generally for encircling an associated portion of the outer face 4B of the body 4 of this neck. Snug cooperation between the skirt portion 23 and the shoulder protrusion 7 of the neck 3 stabilizes and/or reinforces the attachment of the skirt 20 around the neck when the plug 1 is in a closing configuration on the neck, while allowing outer covering of the neck.

In the relevant embodiment in the figures, the inner face 24A of the intermediate skirt portion 24 has portions bulging inwards 25, distributed along the inner periphery of this skirt portion 24, as this is well visible in FIG. 5. These bulging portions 25 are located, along the direction of the axis X-X, in the top region of the skirt portion 24 so as to gradually reduce the inner transverse dimension of the skirt portion 24 when the latter is covered from bottom to top. Thus, notably insofar that the respective outer faces of the skirt portions 23 and 24 form together a substantially cylindrical surface with a constant circular base, the skirt portion 24 has, in its bulging portions 25, an increasing thickness when this skirt portion 24 is covered from the skirt portion 23 to the skirt portion 21, which correspondingly decreases the transverse flexibility of the skirt portion 24.

Advantageously, along the periphery of the skirt 20, the interruptions between two of the bulge portions 25 which are in succession, occupy the same angular positions as the interruptions of the bulging line 22, as this is well visible in FIG. 5: these interruptions thus form together several vent channels 26 which are distributed along the periphery of the skirt 20, each vent channel 26 extends axially over both the bottom portion of the inner face 21A of the skirt portion 21 and the top portion of the inner face 24A of the skirt portion 24. These vent channels 26 facilitate the setting into place of the plug 1 on the neck 3 with view to obturating the latter, in the sense that all air overpressure which may be generated between the skirt portion 21 and the neck 3 is neutralized by the presence of the vent channels 26.

The skirt 20 is moreover provided with a weakening line 27 designed, so as to be broken under the action of the user so as to separate either one of the portions of the skirt 20 which were initially connected to each other through this weakening line 27. In practice, it is understood that the weakening line 27 is broken by a user when the latter wishes to free in totality the plug 1 relatively to the neck 3 of the container 2, notably for purposes of reusing this container. In the embodiment considered in the figures, the weakening line 27 includes a portion 27.1 which is located at a substantially constant axial level of the skirt 20 and which runs over a portion of the periphery of the skirt along the bulging line 21 on the one hand, and, a portion 27.2 which connects the weakening line portion 27.1 to the lower free end of the skirt 20, in other words here, to the lower axial end 23B of the shirt portion 23 on the other hand, as this is well visible in FIGS. 4 and 5. Thus, the weakening line portion 27.2 extends over a limited peripheral portion of the skirt portion 23, a portion in which this weakening line portion 27.2 connects the lower axial end 23B of this skirt portion 23 to its upper axial end 23C, from which the weakening line portion 27.2 extends and joins up with the weakening line portion 27.1 while extending in the skirt portion 24. Advantageously, the aforementioned peripheral portion of the skirt portion 23 is provided with a tab 28 protruding downwards from the lower end 23B of the skirt portion 23, in close proximity to the weakening line portion 27.2 along the periphery of the skirt 20: in a way known per se, this tab 28 is provided so as to be grasped by the fingers of a user in order to be moved away from the neck 3 of the container 2, which induces initiation of tearing at the free end of the weakening line portion 27.2.

As this is well visible in FIGS. 2 to 5, the inner face 23A of the skirt portion 23 is provided with ribs 29, which protrude inwards and which are distributed along the inner periphery of this skirt portion 23.

In the embodiment considered in the figures, the ribs 29 are present on the whole inner periphery of the skirt portion 23, and this while being advantageously distributed regularly along this periphery, except in the peripheral portion of this skirt portion 23, in which extends the weakening line portion 27.2 as explained above. This arrangement gives the possibility of avoiding any perturbation of the tearing of the skirt portion 23 in its aforementioned peripheral portion by breaking of the weakening line 27.

For reasons which will become apparent a little later on, each of the ribs 29 connects with each other the lower 23B and upper 230 axial ends of the skirt portion 23. Moreover, in the embodiment considered in the figures, each of these ribs 29 extend axially beyond the upper end 230 of the skirt portion 23, which amounts to stating that these ribs 29 occupy the whole axial extent of the skirt portion 23, as well as at least one lower portion of the axial extent of the skirt portion 24. Extending the foregoing considerations, at least some of the ribs 29 are axially integral with the bulging portions 25 of the skirt portion 24, as this is well visible in FIGS. 4 and 5: so that, the manufacturing, notably by molding, of the ribs 29 is facilitated, while reinforcing their mechanical strength along a direction peripheral to the skirt 20. Furthermore, as an optional arrangement, applied in the embodiment considered here, the ribs 29 located along the periphery of the skirt 20, in the skirt portions of the vent channels 26 extend axially upwards as far as in the top portion of the axial extent of the skirt portion 24, where these ribs 29 are axially made in the same material with inner overthicknesses, as this is well visible in FIGS. 4 and 5.

In the embodiment considered here, the ribs 29 are substantially rectilinear and are substantially parallel to the axis X-X. One of the advantages of this layout is to facilitate manufacturing of the plug 1, notably by molding the latter, in the sense that the ribs 29 are easy to remove from the mold with the remainder of the skirt 20. Moreover, this layout has a remarkable benefit when it is combined with the fact that at least some of the ribs 29 are axially made in the same material with the bulging portions 25, as explained above, and this at least for the same reasons of easy removal from the mold.

In order to well understand the technical benefits related to the presence of the ribs 29, interest will lie hereafter in the operation for placing the plug 1 on the neck 3 with view to obturating the latter. To do this, initially, the plug 1 is brought closer to the neck 3 until it overhangs the latter coaxially as in FIG. 1. The plug 1 and the neck 3 are then brought axially close to each other so as to engage the neck 3 coaxially into the inside of the skirt 20 and to have the heel 6 and the bulging line 22 cooperate with each other. In order to jam the heel 6 between the bulging line 22 and the cap 10, significant axial stress has to be applied in the direction for bringing the cap and the neck closer to each other: at this moment of the placement of the plug, the aforementioned stress necessarily induces axial compression forces of the body 4 of the neck 3, as well as of the whole remainder of the container 2, so that, in particular when this container is a carboy of the type mentioned above, which further is made in a plastic material with moderate stiffness, notably made in polyethylene terephthalate, the level of the liquid contained in the container 2 rises relatively to this container because of the axial compression of the latter. As explained in the introductory portion of the present document, the rise in the level of the liquid may then be such that liquid overflows from the neck 3, by passing over the high axial end 5 of its body 4. Flowing along the outer face 4B of the body 4 of the neck 3, this liquid reaches the groove 8. Because of the adjustment between the skirt portion 23 and the shouldered protrusion 7 of the neck, it is understood that this liquid may rapidly accumulate in the free space delimited radially between the groove 8 and the skirt portion 24. However, rather than being irremediably trapped in this free space, this liquid may then flow downwards, radially between the skirt portion 23 and the shoulder protrusion 7, by passing through flow passages 30 respectively delimited, along the inner periphery of the skirt 20, between two of the ribs 29 which are in succession along this periphery. These flow passages 30 have a function of draining the liquid. Indeed, each of these flow passages opens at the top, into the free space delimited between the skirt portion 24 and the groove 8 and, at the bottom, onto the free end section of the skirt 20 and therefore directly on the outside of the plug 1. Further, as this is well visible in FIG. 3, the inner face 23A of the skirt portion 23 through these ribs 29 bears against the shouldered protrusion 7 of the neck 3 so that the remainder of this inner face 23A is moved slightly radially apart from the shouldered protrusion 7, thereby leaving the flow passages 30 free.

In practice, in particular when the amount of liquid overflowing from the container 2 is significant, it is not excluded that the accumulation of this liquid in the groove 8 be such that all the flow passages 30 are saturated, then preventing air outside the plug 1 from reaching the groove 8, via at least one of the flow passages 30, in order to compensate the negative pressure generated by the discharge of the liquid in the passages 30. In this case, some liquid is retained in the groove 8 by a suction cup effect, upstream from the flow passages 30. The draining of this thereby retained liquid may then be achieved by itself, by tilting the container 2 with respect to the vertical, or by laying it horizontally. Moreover, the container 2 is typically stored and/or transported horizontally.

As a remarkable additional advantage, it will be noted that the ribs 29 form, on the inner face 23A of the skirt portion 23, raised reliefs for manual grasping which a user may easily engage with his/her fingers in order to grasp and notably pull on the skirt 20 when this user seeks to free the plug 1 from the neck 3. This is notably the case when the weakening line 27 is at least partly broken, in the sense that the user generally grasps the portion of the skirt 20 which is located axially under the broken weakening line 27 and which therefore interiorly bears the protruding ribs 29.

Various arrangements and alternatives to the plug 1 described up to now may moreover be contemplated:

Instead of the skirt portion 23, interiorly provided with ribs 29, forming the lower terminal portion of the skirt 20, this skirt may, in an alternative not shown, include an additional axial portion, extending downwards in the extension of the skirt portion 23; in this case, optionally, the ribs 29 may be extended from the portion of the skirt 23 as far as at least the top of this additional skirt portion, which amounts to stating that the ribs 29 then extend axially downwards beyond the skirt portion 23; and/or The container 2 is not necessarily a carboy of the type mentioned above, in the sense that more globally, the invention applies to snapped-on plugs, similar to the plug 1, i.e. plugs for which the skirt includes atop axial portion, capable of interfering by jamming with an outer protruding heel of the neck of a container, and a lower axial portion which substantially encircles snugly an associated portion of the outer face of the neck, such as the shouldered area 7 of the neck 3.

The invention claimed is:

1. A plug for closing a neck of a container, comprising:

a cap for obturating the neck, which, when the plug is in a closing configuration on the neck, is laid out across an inner aperture of the neck, and a skirt for attachment to the neck, the skirt being tubular and centered on an axis, extending axially from the cap and disposed around the neck when the plug is in the closing configuration on the neck, wherein the skirt includes along the axis thereof:

a first skirt portion which connects a remainder of the skirt to the cap and for which an inner face is provided with a peripheral bulging line adapted to interfere by jamming with a protruding heel of an outer face of the neck so as to retain the skirt around the neck, and a second skirt portion having an inner face adapted to substantially encircle snugly an associated portion of the outer face of the neck, wherein the inner face of the second skirt portion is provided with draining means adapted to delimit flow passages for flowing fluid between the second skirt portion and the neck, the flow passages connecting the opposite axial ends of the second skirt portion, wherein the second skirt portion forms a terminal portion of the skirt, opposite the first skirt portion, so that, at an axial end of the second skirt portion axially opposite the first skirt portion, the flow passages open freely on an outside of the plug, and wherein the skirt includes a peripheral weakening line adapted to be broken by propagation of a tearing of the skirt along the weakening line when the plug is to be removed from the neck, wherein a portion of the weakening line connects the opposite axial ends of the second skirt portion while extending at an angle oblique to the axis and in a peripheral portion of the second skirt portion that is without the draining means.

2. The plug according to claim 1, wherein at least one portion of the draining means forms, on the inner face of the second skirt portion, raised reliefs for manual grasping, in particular for facilitating the freeing of the skirt when the plug is to be removed from the neck.

3. The plug according to claim 1, wherein at an axial end of the second skirt portion, turned axially towards the first skirt portion, the flow passages open into a free space to be drained, which, when the plug is in the closing configuration on the neck, is delimited radially between a third portion of the skirt, connecting the first and second skirt portions with each other and a groove of the outer face of the neck.

4. The plug according to claim 1, wherein the draining means comprise ribs which protrude from the inner face of the second skirt portion and which are distributed along a periphery of the inner face of the second skirt portion so that at least some of the flow passages are delimited by two of these ribs which are in succession along the periphery of the inner face of the second skirt portion.

5. The plug according to claim 4, wherein the ribs, between Which at least some of the flow passages are delimited, are distributed regularly along the periphery of the inner face of the second skirt portion.

6. The plug according to claim 4, wherein the ribs are substantially rectilinear and substantially parallel to the axis.

7. The plug according to claim 4, wherein each of at least some of the ribs is axially integral with an interiorly bulging portion of a third portion of the skirt, connecting the first skirt portion and the second skirt portion to each other along the axis.

8. A packaging assembly, including a container and a plug for closing a neck of the container, wherein the plug is in accordance with claim 1, and the container is a carboy in polyethylene terephthalate, which is used in an upside down position in which its the neck is turned towards the ground.

* * * * *